US009915044B2

(12) United States Patent
Kalkman

(10) Patent No.: US 9,915,044 B2
(45) **Date of Patent: *Mar. 13, 2018**

(54) WALKWAY INSTALLATION, AS WELL AS A VESSEL WITH SUCH A WALKWAY INSTALLATION

(71) Applicant: Kalkman IP B.V., Waddinxveen (NL)

(72) Inventor: Pieter Kalkman, Waddinxveen (NL)

(73) Assignee: Kalkman IP B.V., Waddinxveen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/723,957

(22) Filed: Oct. 3, 2017

(65) Prior Publication Data

US 2018/0023262 A1 Jan. 25, 2018

Related U.S. Application Data

(63) Continuation of application No. 15/028,835, filed as application No. PCT/NL2014/050713 on Oct. 14, 2014, now Pat. No. 9,797,101.

(30) Foreign Application Priority Data

Oct. 14, 2013 (NL) ..... 2011603

(51) Int. Cl.
*E01D 15/24* (2006.01)
*B63B 27/14* (2006.01)
(Continued)

(52) U.S. Cl.
CPC ..... *E01D 15/24* (2013.01); *B63B 27/14* (2013.01); *E01D 15/02* (2013.01); *E01D 15/04* (2013.01); *B63B 2027/141* (2013.01)

(58) Field of Classification Search
CPC ..... E01D 15/24; E01D 15/02; E01D 15/04; B63B 27/14; B63B 2027/141
(Continued)

(56) References Cited

U.S. PATENT DOCUMENTS 4,169,296 A * 10/1979 Wipkink ..... E01D 15/24 14/35
4,590,634 A * 5/1986 Williams ..... E01D 15/24 114/230.1
(Continued)

FOREIGN PATENT DOCUMENTS

DE 7401974 U 4/1974
EP 2505486 A1 10/2012
(Continued)

*Primary Examiner* — Raymond W Addie
(74) *Attorney, Agent, or Firm* — Bret E. Field; Bozicevic, Field & Francis LLP

(57) ABSTRACT

A walkway installation comprising a base (1) intended to be fastened to a support construction, such as to the deck (5) of a ship (6), as well as a base bridge part (2) that is connected at one end so it can be rotated around an upright base axis of rotation (11) with the base. Furthermore, a main bridge part (4) is provided on the other end of the base bridge part (1) as well as a hinge construction between the base bridge part (1) and the main bridge part (2). The hinge construction has an upright main axis of rotation (12) and an auxiliary axis of rotation (13) aligned transversely to the upright main axis of rotation and transversely to the main bridge part. By rotating the gangplank parts, the installation may be adjusted in a reliable and quick way in relation to a fixed object or another vessel.

21 Claims, 5 Drawing Sheets

(51) Int. Cl.
*E01D 15/02* (2006.01)
*E01D 15/04* (2006.01)

(58) Field of Classification Search
USPC ..... 14/2.4–2.6, 27, 73.1
See application file for complete search history.

(56) References Cited

U.S. PATENT DOCUMENTS 5,573,363 A * 11/1996 Rohr ..... B63B 27/22 414/138.7
6,923,140 B1 * 8/2005 Cook ..... E01D 15/24 114/362
7,950,095 B2 * 5/2011 Honeycutt ..... B21D 5/00 14/69.5
8,127,388 B2 * 3/2012 Watchorn ..... B63B 27/143 14/2.6
8,402,584 B2 * 3/2013 Westermark ..... B63B 27/143 114/362
8,479,882 B2 * 7/2013 DuBose ..... B60P 1/00 182/113
8,584,290 B2 * 11/2013 Asbjorn ..... E01D 15/24 114/362
8,746,403 B1 * 6/2014 Tyner ..... E06C 1/30 182/106
8,813,912 B2 * 8/2014 Bennett ..... B66F 11/04 182/113
9,133,014 B2 * 9/2015 Kenan ..... B67D 7/40
9,777,446 B2 * 10/2017 Nes ..... E01D 15/20

FOREIGN PATENT DOCUMENTS

SU 494306 A1 12/1975
WO WO8702723 A1 5/1987
WO WO0220343 A1 3/2002
WO WO2009118767 A1 10/2009

* cited by examiner

WALKWAY INSTALLATION, AS WELL AS A VESSEL WITH SUCH A WALKWAY INSTALLATION

The invention relates to a walkway installation, comprising a base intended to be fastened to a support construction, such as the deck of a ship, a base bridge part that is connected to the base at one end so it can rotate around an upright base axis of rotation, a main bridge part at the other end of the base bridge part as well as a hinge construction between the base bridge part and the main bridge part, wherein the hinge construction comprises an upright main axis of rotation and an auxiliary axis of rotation aligned transversely to the upright main axis of rotation as well as transversely to the main bridge part.

Such a walkway installation is known from SU-A-494306. The base bridge part of the same is rotatable about a vertical axis of rotation and a horizontal axis of rotation in such a way that the extremity of the same can be positioned next to an object, such as a platform. The walkway installation may be brought, in the desired rotational position, between a vessel and an adjacent object by means of cables. Given the vessel must remain at a safe distance from the object, the base bridge part and the main bridge part must be able to be rotated quite far outwards. Furthermore, it is necessary to be able to respond quickly with these movements to the movements of the vessel, in such a way that undesirable impact loads between the main bridge part and the object can be avoided.

The disadvantage of such a known walkway installation is that it is difficult to displace the walkway installation reliably and at the desired speed. The aim of the invention, therefore, is to create a walkway installation of the type mentioned above that can better respond to the mutual movements of, for example, a vessel and an adjacent object. The aim is achieved by the base bridge part being able to rotate around only the upright base axis of rotation. The walking surface of the base bridge part may be flat or level, or provided with steps. The walking surface may run essentially horizontally (at rest), but it is also possible to provide an inclined walking surface. In the latter case, as an alternative a staircase with step-shaped surface can be applied.

In the walkway installation in accordance with the invention, the differences in movement can be responded to quickly by manipulating the base bridge part around only the base axis of rotation of the same. After the base bridge part is thus brought into a certain desired position, the main bridge part can be rotated around the auxiliary axis of rotation so as to bring it to the desired height in relation to the object to be approached, such as a fixed platform or another vessel. The main bridge part can also be rotated around the main axis of rotation of the same. The rotations may be implemented reliably and quickly so that, by a suitable choice of rotations around the base axis of rotation and the main axis of rotation the desired position, more or less pointing outwards from the free end of the main bridge part, can be ensured. In setting the height alignment of the main bridge part around the auxiliary axis of rotation, only the mass of that main bridge part plays a role. As a result of this, for a certain power of the adjustment drive, the adjustment of the main bridge part can be done faster, given that the mass of the base bridge part has no effect on this.

The free end of the main bridge part can therefore be positioned precisely on an object such as a vessel or a quay, platform and similar. With the aim of simplifying the transfer, on the end of the main bridge part away from the hinge construction, a platform that can be rotated about an axis of rotation is suspended which is essentially parallel to the auxiliary axis of rotation. A floating body may be provided on the platform in connection with the transfer from a small boat or to rescue a person from drowning.

The hinge construction may comprise a gangplank intermediate piece or intermediate platform that operates together via the main axis of rotation with the base bridge part and via the auxiliary axis of rotation with the main bridge part. The gangplank intermediate piece may be embodied as a platform, through which the main bridge part and the base bridge part are connected to each other in such a way that is it possible to walk freely over the entire walkway installation.

To adjust the walkway installation, various drives may be provided. Between the gangplank intermediate piece and the main bridge part, a main drive, such as a hydraulic piston/cylinder unit, may be provided to adjust the main bridge part around the main axis of rotation. Between the gangplank intermediate piece and the main bridge part, an auxiliary drive, such as one or more hydraulic piston/cylinder mechanisms, may be provided in between to adjust the main bridge part around the auxiliary axis of rotation. Furthermore, between the base and the base bridge part, a base drive, such as a hydraulic piston/cylinder mechanism, may be provided to adjust the base bridge part around the base axis of rotation.

In a simple embodiment, the base axis of rotation and the main axis of rotation are parallel. In particular, the base axis of rotation and the main axis of rotation may be aligned essentially vertically and the auxiliary axis of rotation may be essentially aligned horizontally.

Furthermore, an operating mechanism may be provided, comprising a movement reference unit to establish relative movements of the free end of the main bridge part in relation to an object, as well as a control unit for controlling the main drive and/or the auxiliary drive and/or the base drive on the basis of the control signals given by the movement reference unit.

The main bridge part may consist of a single part, but it is also possible to implement the main bridge part telescopically. The adjustment to the position of the object can also be achieved by extending/contracting the telescopic main bridge part. Furthermore, the base bridge part and the main bridge part may both be provided on each side with a barrier. The gangplank intermediate piece may also be provided with barrier.

When the walkway installation is not in use, the various hinge options can be used to give it a limited volume for storage. To achieve this, the main axis of rotation is preferably arranged eccentrically in relation to the base bridge part and the main bridge part in such a way that the base bridge part and the main bridge part can be brought parallel next to each other in a collapsed condition. In that case, the barrier of the gangplank intermediate piece is essentially concentric in relation to the main axis of rotation.

The walkway installation may be arranged permanently, yet an implementation is also conceivable in which the walkway installation is mobile or interchangeable. In that case, the base is preferably implemented with dimensions in accordance with those of the base of an ISO container, and ISO connectors are attached to the four corners. By means of these connectors, the walkway installation can be easily fixed to corresponding positions on the deck of a vessel and similar, or can be removed therefrom after temporary use.

The invention further relates to a vessel, comprising a walkway installation such as described above. The base of the walkway installation may, for example, be attached to the hull, such as to the deck, the superstructure and similar of the vessel.

A walkway installation can also be understood to be a gangplank installation. Such a walkway installation may exhibit a part that is implemented as a plank. Furthermore, a part in the form of a staircase or also in the form of a plank may be present.

The invention shall be described further using the embodiment represented in the figures.

Figure 1:
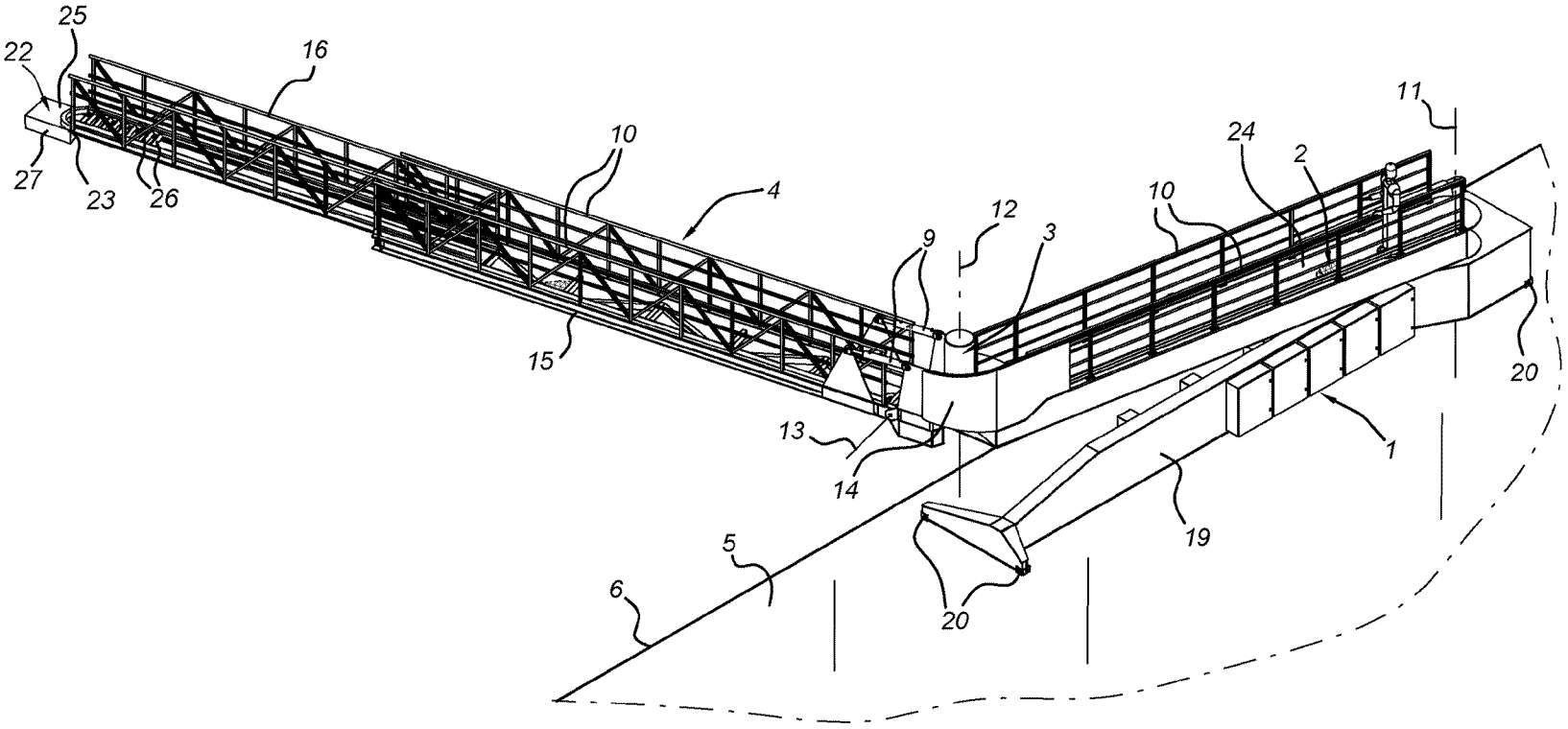
FIG. 1 shows a perspective view of the walkway installation while in use and in an extended state.
Figure 2:
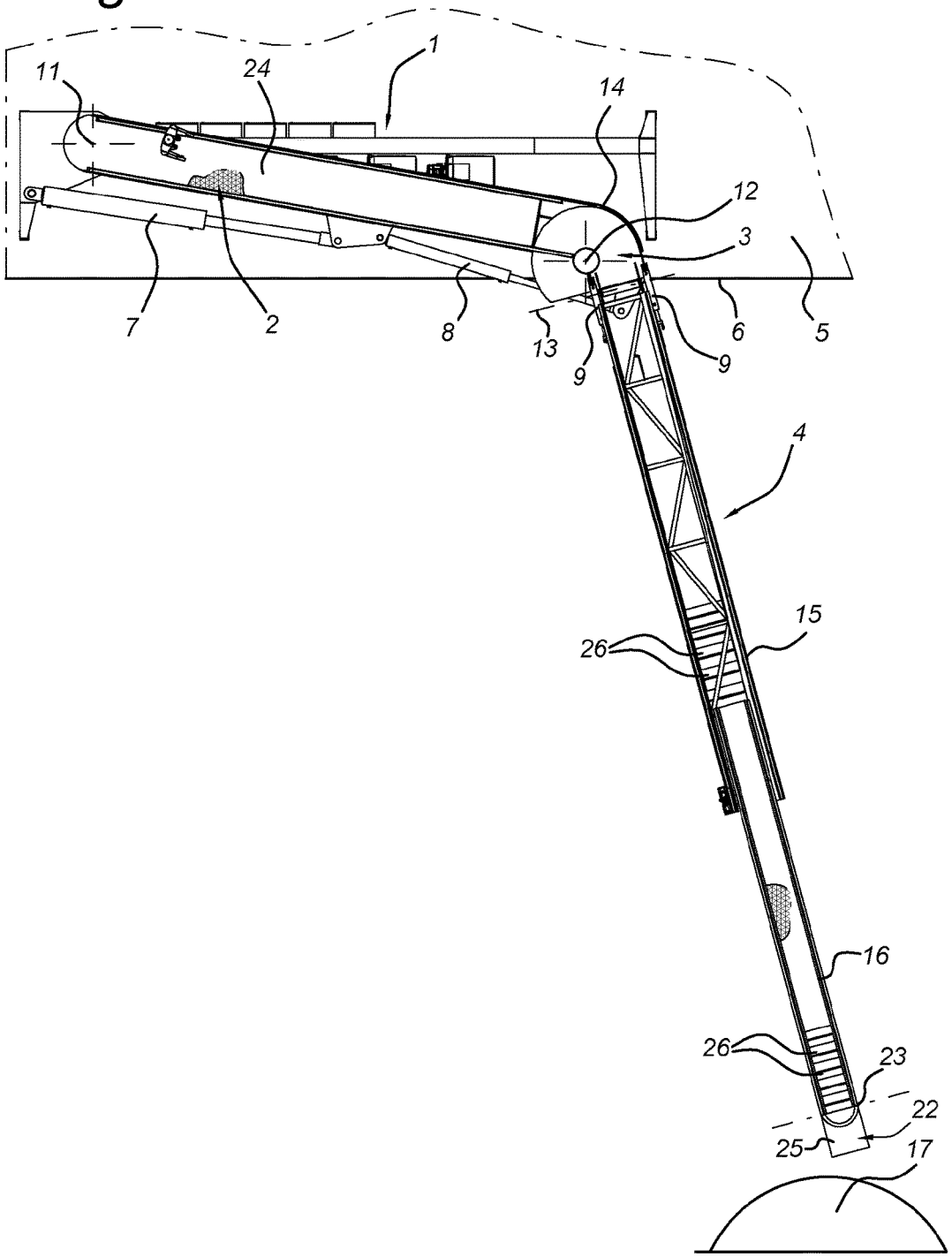
FIG. 2 shows a plan view of FIG. 1.

The walkway installation represented in FIGS. 1 and 2 consists of the base 1, the base bridge part 2, the intermediate platform 3 and the main bridge part 4. This walkway installation is mounted on the deck 5 of an only partially-represented vessel 6. The base bridge part has a flat walking surface 24 and is swiveled outward somewhat by means of the piston/cylinder mechanism 7 in relation to the base 1 around the base axis of rotation 11. The intermediate platform 3 is swiveled with the main bridge part 4 in relation to the base bridge part 2 by means of the piston/cylinder mechanism 8 around the main axis of rotation 12. The main bridge part 4 is also swiveled up in relation to the platform 3 by means of the piston/cylinder mechanisms 9 around the auxiliary axis of rotation 13. These piston/cylinder mechanisms 9 are, on the one hand, fastened to the top of the barrier 14 of the intermediate platform 3 and, on the other hand, to the barrier 10 of the main bridge part 4, and in particular, to the web plates 18 of the same, as represented in FIG. 4.

Figure 5:
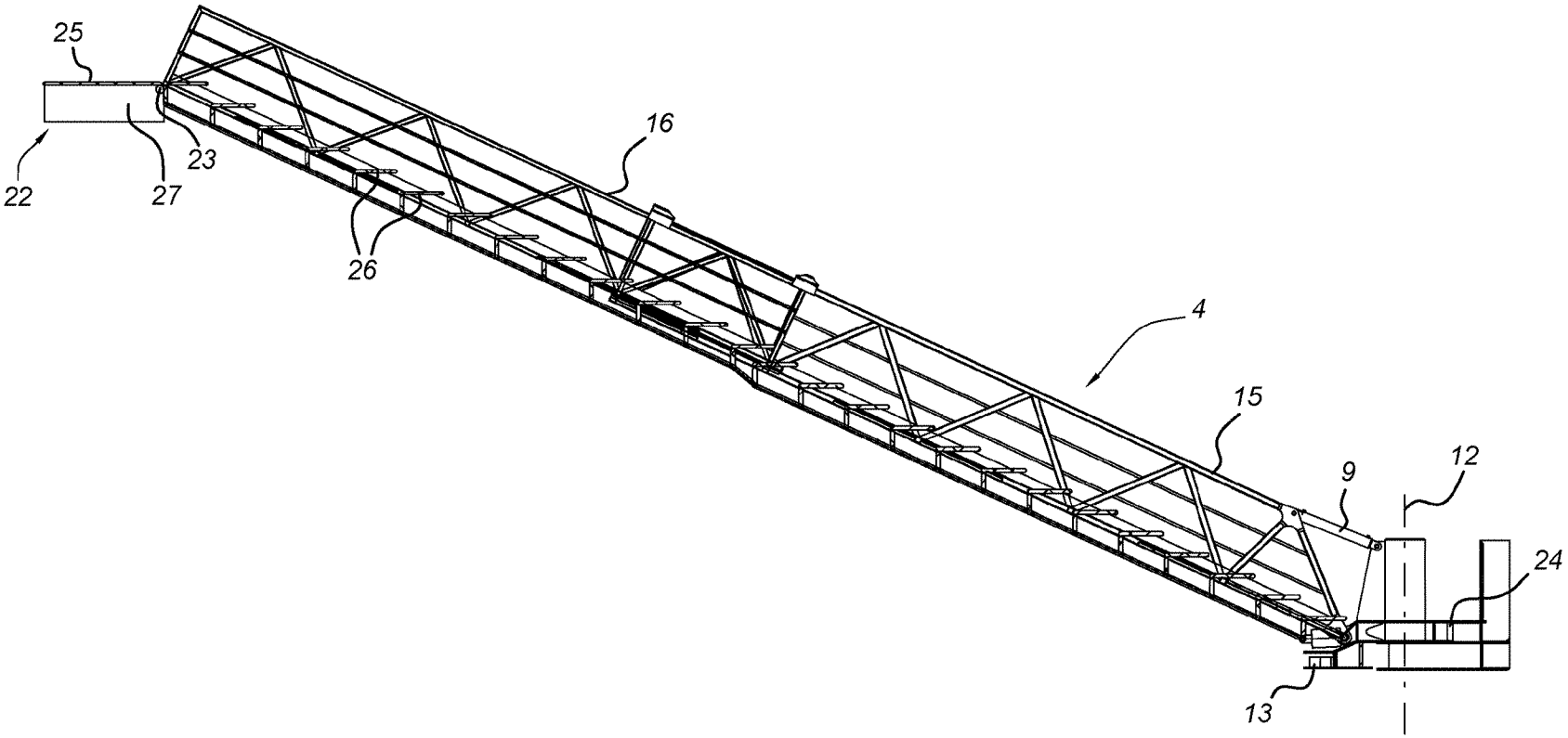
FIG. 5 shows a longitudinal cross-section through the main bridge part and intermediate platform.

The main bridge part 4 is a staircase with rotating steps 26 in the represented illustrative example. Furthermore, the main bridge part 4 is implemented telescopically with the two parts 15, 16. By extending part 16, together with the aforementioned rotational movements, the extremity of the walkway installation may be held next to an object, such as the leg 17 of a platform, for example. As represented in FIG. 5, a platform 22 is mounted onto the free end of the main bridge part 4 so it can rotate about an axis of rotation 23 transversely onto the main bridge part. Via the upper surface 25 of the platform 22, which is preferably parallel to the steps 26 and the upper surface of the intermediate platform 3, the transfer from the deck of the vessel, for example, can be made simply. The platform 22 may also be provided with a floating body 27, which is useful in connection with a transfer close to the surface of the water, such as when rescuing a person from drowning.

Onto the base bridge part 2 and the main bridge part 4, barriers 10 are attached. The intermediate platform 3 supports a barrier 14 that is concentric in relation to the main axis of rotation 12. As represented in FIG. 2, the main axis of rotation is arranged eccentrically in relation to the base bridge part 2 and the main bridge part 4, in such a way that, when the same are at rest, they can be stored next to each other as represented in FIGS. 3 and 4.

Figure 3:
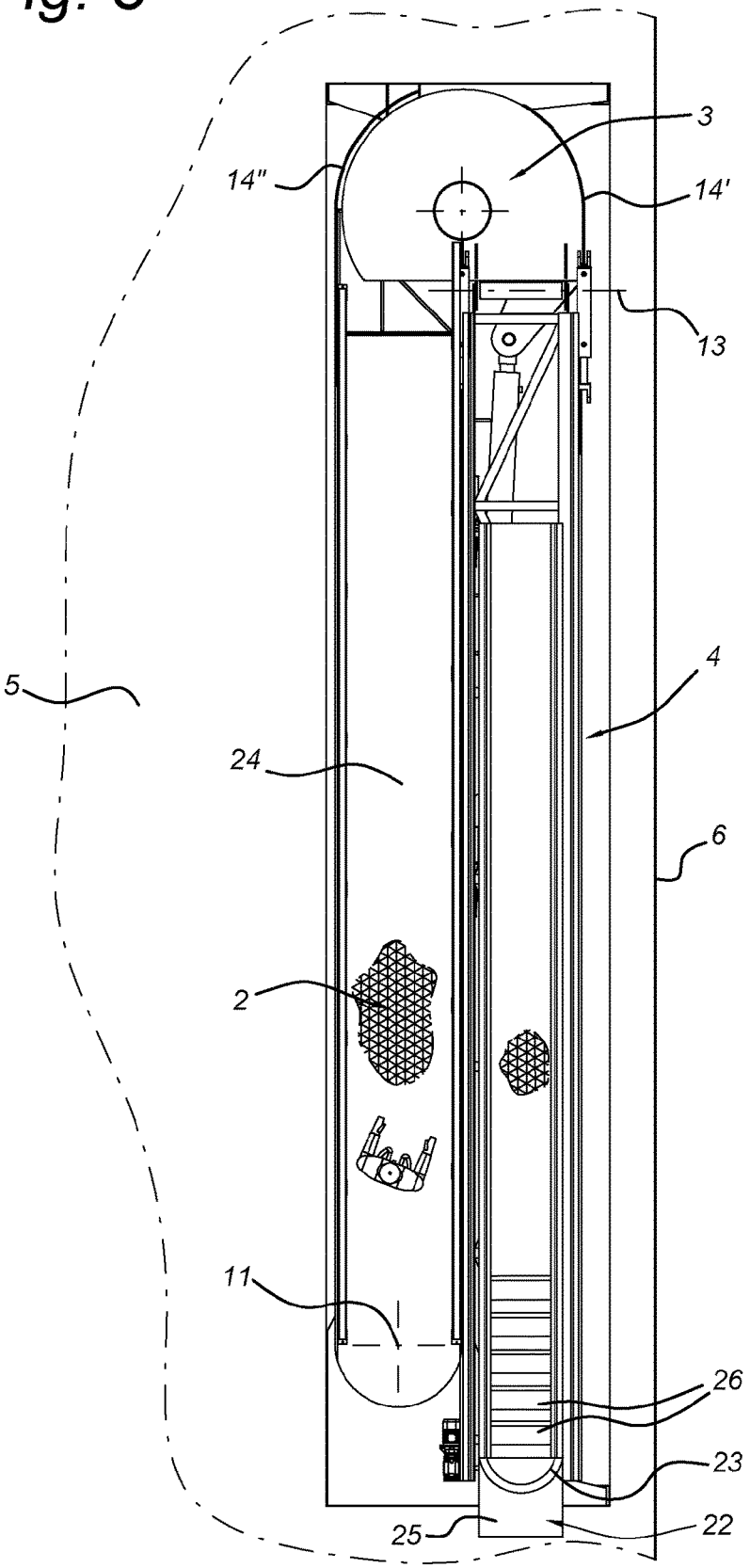
FIG. 3 shows the walkway installation in a collapsed state and in plan view.
Figure 4:
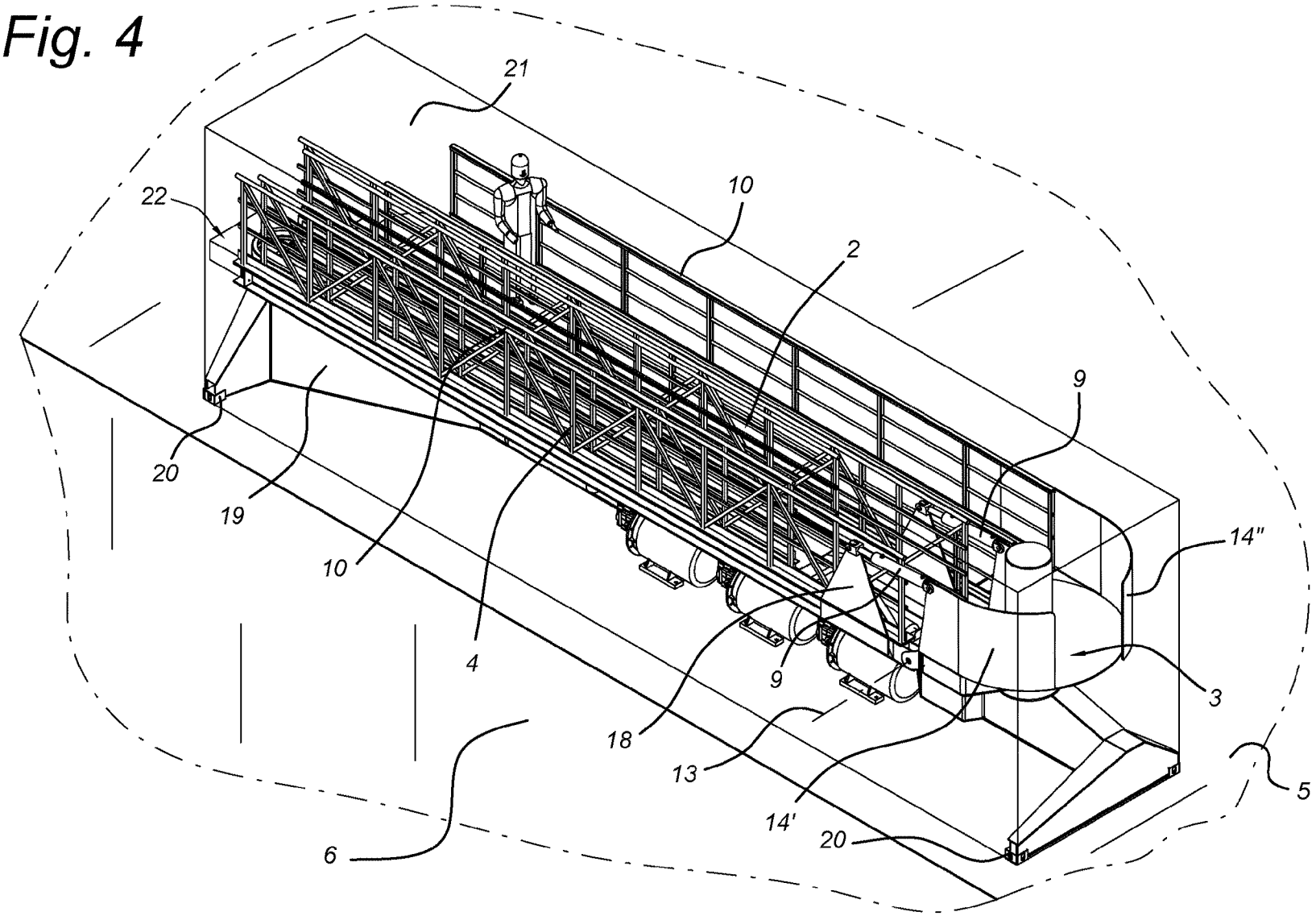
FIG. 4 shows the walkway installation in a collapsed state in perspective and accommodated in a container.

As represented in FIGS. 3 and 4, the barrier 14 of the intermediate platform 3 consists of two parts 14' and 14". Part 14' is fastened to the main bridge part 4, while part 14" is fastened to the base bridge part. When the main bridge part 4 rotates in relation to the base bridge part 2, these parts 14' and 14" are moved alongside each other in such a way that a closed barrier 14 is still maintained.

The base 1 consists of a frame 19 with ISO connectors 20 on the four corners, by means of which the walkway installation can be connected to the corresponding connectors on the deck 5 of the vessel 6. However, a different, permanent arrangement is also possible. The entire walkway installation may be provided with a closed container shell 21 as reproduced in FIG. 4. When in use, this container shell first has to be removed, after which the walkway installation can be extended.

LIST OF REFERENCE NUMBERS

1. Base
2. Base bridge part
3. Intermediate platform
4. Main bridge part
5. Deck
6. Vessel
7. Base drive
8. Main drive
9. Auxiliary drive
10. Barrier
11. Base axis of rotation
12. Main axis of rotation
13. Auxiliary axis of rotation
14. Barrier
15. Part of main bridge part
16. Part of main bridge part
17. Object
18. Web plate
19. Frame
20. ISO connector
21. Container shell
22. Platform
23. Axis of rotation of platform 22
24. Walking surface of base bridge part
25. Walking surface of platform 22
26. Steps of main bridge part
27. Floating body

The invention claimed is:

1. A walkway installation, comprising a base intended to be fastened to a support construction, a base bridge part that is connected with the base at one end so it can be rotated around an upright base axis of rotation, a main bridge part on the other end of the base bridge part as well as a hinge construction between the base bridge part and the main bridge part, wherein the hinge construction comprises an upright main axis of rotation and an auxiliary axis of rotation aligned transversely to the upright main axis of rotation as well as transversely to the main bridge part, and wherein the walkway installation further comprises a main drive provided between the hinge construction and the base bridge part for adjusting the main bridge part around the main axis of rotation.

2. The walkway installation according to claim 1, wherein the walking surface of the base bridge part is flat or level, or is provided with steps.

3. The walkway installation according to claim 1, wherein at the end of the main bridge part away from the hinge construction, a platform is suspended so it can rotate around an axis of rotation that is essentially parallel to the auxiliary axis of rotation as well as a possibly floating body on the platform.

4. The walkway installation according to claim 3, wherein the platform has a walking surface that is essentially parallel to the walking surface of the base bridge part.

5. The walkway installation according to claim 1, wherein the main bridge part is implemented as a staircase with rotatable steps which are preferably parallel to the walking surface of the base bridge part and/or the walking surface of the platform.

6. The walkway installation according to claim 1, wherein the hinge construction comprises a gangplank intermediate piece or intermediate platforms that works together via the main axis of rotation with the base bridge part and via the auxiliary axis of rotation with the main bridge part.

7. The walkway installation according to claim 6, wherein the main drive is provided between the gangplank intermediate piece and the base bridge part for adjusting the main bridge part around the main axis of rotation.

8. The walkway installation according to claim 6, wherein an auxiliary drive is provided between the gangplank intermediate piece and the main bridge part for adjusting the main bridge part around the auxiliary axis of rotation.

9. The walkway installation according to claim 6, wherein a base drive is provided between the base and the base bridge part for adjusting the base bridge part around the main axis of rotation.

10. The walkway installation according to claim 7, wherein an operating mechanism is provided comprising a movement reference unit to establish relative movements of the free end of the main bridge part in relation to an object, as well as a control unit for controlling the main drive and/or the auxiliary drive and/or the base drive on the basis of the control signals given by the movement reference unit.

11. The walkway installation according to claim 1, wherein the base axis of rotation and the main axis of rotation are parallel and/or the auxiliary axis of rotation is aligned perpendicular in relation to the base axis of rotation and/or the main axis of rotation.

12. The walkway installation according to claim 1, wherein the base bridge part and the main bridge part are provided with a barrier on both opposite sides, and/or the gangplank intermediate piece is provided with a barrier.

13. The walkway installation according to claim 1, wherein the main axis of rotation is arranged eccentrically in relation to the base bridge part and the main bridge part in such a way that the base bridge part and the main bridge part can be brought parallel next to each other in a collapsed condition.

14. The walkway installation according to claim 1, wherein the base is implemented with dimensions in accordance with those of the base of an ISO container and ISO connectors are attached to the four corners.

15. A vessel comprising a walkway installation according to claim 1.

16. The walkway installation according to claim 1, wherein the support construction comprises a deck of a ship.

17. The walkway installation according to claim 7, wherein the main drive comprises a hydraulic piston/cylinder unit.

18. The walkway installation according to claim 8, wherein the auxiliary drive comprises one or more hydraulic piston/cylinder mechanism.

19. The walkway installation according to claim 9, wherein the base drive comprises a hydraulic piston/cylinder mechanism.

20. A method for operating a walkway installation comprising a base intended to be fastened to a support construction, a base bridge part that is connected with the base at one end so it can be rotated around an upright base axis of rotation, a main bridge part on the other end of the base bridge part as well as a hinge construction between the base bridge part and the main bridge part, wherein the hinge construction comprises an upright main axis of rotation and an auxiliary axis of rotation aligned transversely to this upright main axis of rotation as well as transversely to the main bridge part, and wherein the method for operating comprises adjusting the main bridge part around the main axis of rotation by means of a main drive provided between the hinge construction and the base bridge part.

21. The method according to claim 20, wherein the support construction comprises a deck of a ship.

* * * * *